United States Patent [19]

Scott

[11] Patent Number: 4,499,358

[45] Date of Patent: Feb. 12, 1985

[54] DRIVING CIRCUIT FOR RADIO FREQUENCY DRYER

[75] Inventor: Burton W. Scott, Plano, Tex.

[73] Assignee: The Mead Corporation, Dayton, Ohio

[21] Appl. No.: 593,988

[22] Filed: Mar. 27, 1984

[51] Int. Cl.[3] ..... H05B 6/08

[52] U.S. Cl. ..... 219/10.77; 219/10.41; 34/1

[58] Field of Search ..... 219/10.77, 10.75, 10.61 R, 219/10.41; 34/1; 340/658

[56] References Cited

U.S. PATENT DOCUMENTS

| | | | |
|---|---|---|---|
| 3,705,819 | 12/1972 | Heller et al. | 34/1 X |
| 3,718,852 | 2/1973 | Bailey | 219/10.77 X |
| 3,740,859 | 6/1973 | Patton et al. | 34/1 |
| 3,921,092 | 11/1975 | Schatz | 219/10.77 X |
| 4,035,599 | 7/1977 | Kashyap et al. | 219/10.55 X |
| 4,114,010 | 9/1978 | Lewis | 219/10.77 X |
| 4,280,038 | 7/1981 | Havas et al. | 219/10.77 |
| 4,289,946 | 9/1981 | Yarwood et al. | 219/10.77 X |

*Primary Examiner*—Philip H. Leung

*Attorney, Agent, or Firm*—Biebel, French & Nauman

[57] ABSTRACT

A driving circuit for supplying a radio frequency electrical signal to the applicator section of a radio frequency dryer includes a voltage controlled oscillator, supplying a signal to an amplifier circuit. The amplifier circuit supplies an amplified signal to the applicator section of the dryer via an impedance match circuit. The signal supplied to the applicator section is compared in phase with the output of the voltage controlled oscillator and phase deviations are utilized to produce a signal which controls the frequency of the voltage controlled oscillator output, such that the applicator section of the dryer is driven at its resonant frequency.

9 Claims, 2 Drawing Figures

DRIVING CIRCUIT FOR RADIO FREQUENCY DRYER

BACKGROUND OF THE INVENTION

The present invention relates to a driving circuit for supplying a radio frequency electrical signal to the applicator section of a radio frequency dryer and, more particularly, to a driving circuit which supplies a radio frequency signal at a frequency substantially equal to the resonant frequency of the applicator section.

Radio frequency drying systems are particularly advantageous for drying ink on paper sheets or a paper web. It is, of course, desirable to apply radio frequency power to the dryer applicator section in as efficient a manner as possible. This implies controlling the potential level of the radio frequency signal applied to the applicator section and further requires control of the loading of the power amplifier in the driving circuit. The best efficiency in such a system is obtained if the unloaded Q of the applicator section is as high as possible. If paper bearing very little ink or a great deal of ink passes through the dryer, the resonant frequency, the loading, and the Q of the system will vary substantially. The problem, therefore, is to adjust the frequency of the driving signal so that it equals the resonant frequency of the applicator section and, further, to maintain both a desired amplitude of driving signal and an efficient transfer of the driving signal into the applicator section in the face of widely varying loading.

A need exists for a driving circuit capable of supplying a radio frequency electrical signal to the applicator section of a radio frequency dryer in an efficient, controlled fashion at a predetermined voltage level and at the resonant frequency of the dryer section.

SUMMARY OF THE INVENTION

A driving circuit for supplying a radio frequency electrical signal to the applicator section of a radio frequency dryer of the type which applies a fluctuating electromagnetic field to a printed sheet or web to induce evaporation of ink therefrom, includes a voltage controlled oscillator means for providing an oscillator output signal which is substantially uniform in amplitude and which is related in frequency to the control voltage supplied to a frequency control input of the voltage controlled oscillator means. An amplifier means receives the oscillator output signal and provides a radio frequency drive signal. Means is provided for supplying the radio frequency drive signal to the applicator section of the dryer as the radio frequency electrical signal so as to produce the fluctuating electromagnetic field. A phase detector means includes means, responsive both to the radio frequency electrical signal supplied to the applicator section and to the oscillator output signal, for providing a frequency control signal to the frequency control input of the voltage controlled oscillator means. The frequency control signal is directly related to the phase difference between the radio frequency electrical signal supplied to the applicator section and the oscillator output signal, whereby the voltage controlled oscillator means drives the applicator section at substantially the resonant frequency of the applicator section.

The amplifier means may include a drive amplifier connected to receive the oscillator output signal from the voltage controlled oscillator means. The drive amplifier provides amplification of the oscillator output signal in response to a control voltage supplied to a gain control input of the drive amplifier. A power amplifier is connected to receive the amplified oscillator output signal from the drive amplifier and to provide the radio frequency drive signal in response thereto. Further included in the amplifier means is a means for providing a control voltage to the gain control input in response to the amplitude of the radio frequency electrical signal, whereby control of the amplitude of the radio frequency electrical signal is effectively provided.

The means for providing a control voltage to the gain control input may include a detector, responsive to the radio frequency electrical signal, for providing a D.C. feedback level, and means for supplying a D.C. reference level. The means for providing a control voltage may include comparator means, responsive to the D.C. feedback level and the D.C. reference level, for supplying the control voltage to the gain control input of the drive amplifier.

The means for supplying the radio frequency drive signal to the applicator section of the dryer as the radio frequency electrical signal may include means from matching the output impedance of the amplifier means with the input impedance of the applicator section, whereby the radio frequency electrical signal is efficiently supplied to the applicator section. The means for matching the output impedance of the amplifier means with the input impedance of the applicator section may include an impedance transformation circuit, connected to the output of the amplifier means and to the applicator section, with the transformation circuit having a control input. A directional coupler is connected to the output of the amplifier means and provides a D.C. impedance control signal in response to the amplitude of the radio frequency reflected power. A comparator circuit is connected to receive the D.C. impedance control signal and a reference signal and supplies an output signal to the control input of the impedance transformation circuit in response thereto. The impedance transformation circuit may include a servomotor control which is connected to receive the output from the comparator circuit.

A method of driving the applicator section of a radio frequency dryer with a radio frequency electrical signal may include the steps of:

(a) generating an A.C. oscillator output signal,
(b) amplifying the oscillator output signal to produce a radio frequency drive signal,
(c) supplying the radio frequency drive signal to the applicator section of the dryer as the radio frequency electrical signal, and
(d) detecting the phase of both the radio frequency electrical signal and the A.C. oscillator output signal, and adjusting the frequency of the A.C. oscillator output signal in response to phase differences between the radio frequency electrical signal and the A.C. oscillator output signal, whereby the applicator section is driven at substantially its resonant frequency.

The method may further include the steps of monitoring the amplitude of the radio frequency electrical signal, and adjusting the amount of amplification of the oscillator output signal to produce a radio frequency electrical signal of desired amplitude. The method may additionally include the steps of monitoring the amplitude of the reflected power, and adjusting the effective input impedance of the applicator section to permit efficient power transfer thereto.

Accordingly, it is seen that it is an object of the present invention to provide a driving circuit and method of operation for the applicator section of a radio frequency dryer in which fluctuations in loading and resonant frequency of the applicator section are monitored and appropriate corrections made; to provide such a driving circuit and method in which the impedance between the circuit and the applicator section is effectively matched; and to provide such a driving circuit and method in which the resonant frequency of the applicator section determines the frequency at which the section is driven.

Other objects and advantages of tne invention will be apparent from the following description, the accompanying drawings and the appended claims.

DETAILED DESCRIPTION OF THE PREFERRED EMBODIMENT

The present invention relates to a driving circuit for supplying a radio frequency electrical signal to the applicator section of a radio frequency dryer. Dryers of this type apply a fluctuating electromagnetic field to an item to be dried, and find particular use in drying a series of sheets which have been printed. For optimum operation, it is desired that the driving circuit be controlled precisely in dependence upon three parameters. The frequency of the radio frequency electrical signal should be precisely the same as the resonant frequency of the loaded dryer applicator section; the radio frequency signal supplied to the applicator section must be driven to a precise voltage level; and the output impedance of the driving circuit and the input impedance of the applicator section should be matched as closely as possible in order to produce optimum power transfer. It will be appreciated that the impedance, loading and resonant frequency of the applicator section all change as the ink in the dryer dries and as sheets carrying differing quantities of ink are sequentially delivered to the dryer. A need exists, therefore, for a circuit which monitors these parameters and makes appropriate adjustments during operation.

Figure 1:
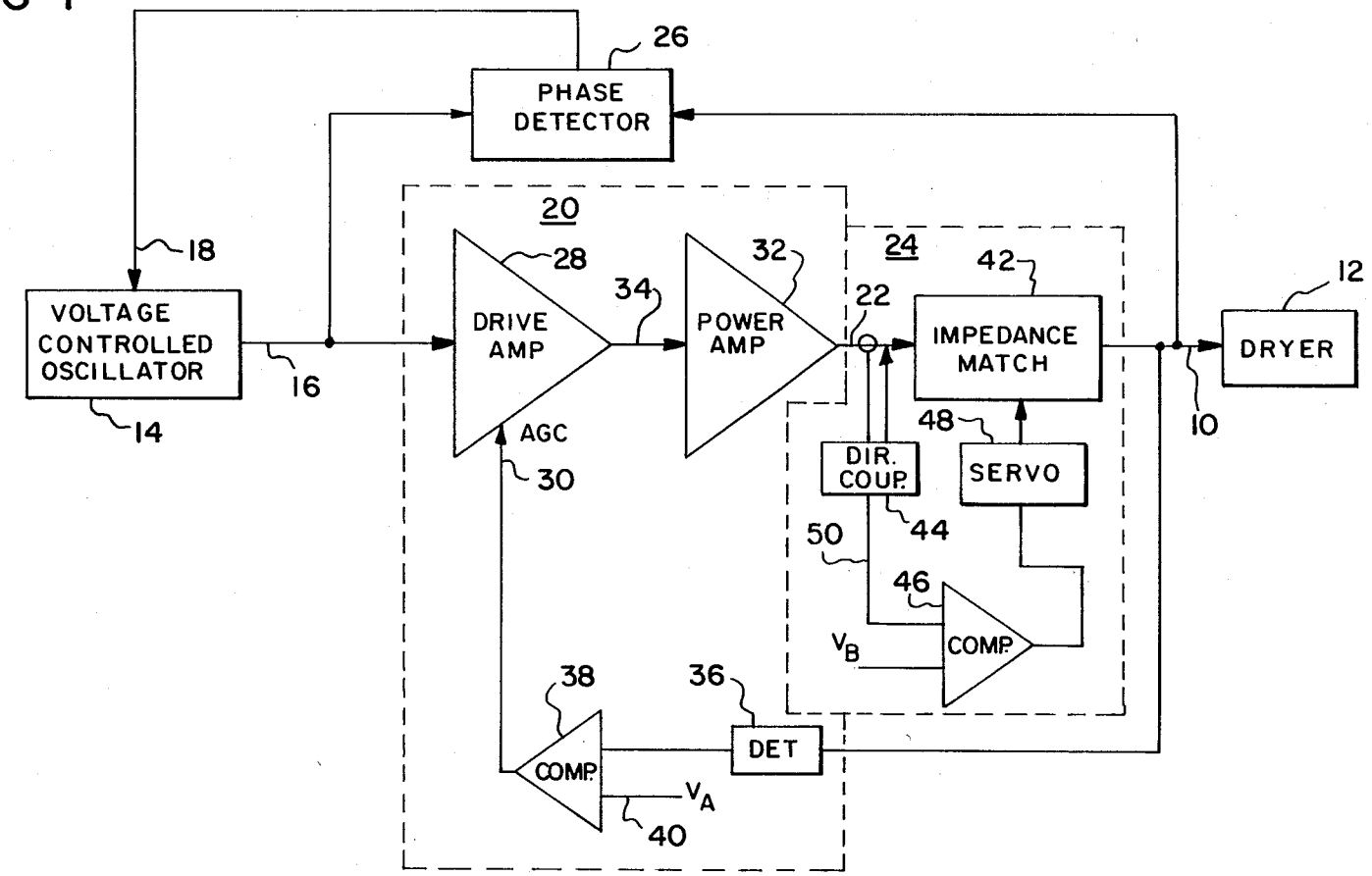
FIG. 1 is a schematic representation of a driving circuit constructed according to the present invention.

A driving circuit according to the present invention which accomplishes these objectives is shown in FIG. 1. The driving circuit which supplies a radio frequency electrical signal on line 10 to the applicator section 12 of the dryer. The circuit includes a voltage controlled oscillator 14 which provides an oscillator output signal on line 16. The oscillator output signal is substantially uniform in amplitude and is related in frequency to the amplitude of the control voltage supplied to frequency control input 18 of the oscillator 14. An amplifier means consisting of amplifier circuit 20 receives the oscillator output signal and provides a radio frequency drive signal on line 22. Circuit 24 provides a means for supplying the radio frequency drive signal from line 22 to the applicator section 12 of the dryer as the radio frequency electrical signal.

The driving circuit further includes a phase detector means 26 which is responsive to the radio frequency electrical signal supplied to the applicator section and to the oscillator output signal. The phase detector means 26 provides a frequency control signal on line 18 to the frequency control input of the voltage controlled oscillator means 14. The frequency control signal is directly related to the phase difference between the radio frequency electrical signal supplied to the applicator section 12 and the oscillator output signal on line 16. As a consequence, the voltage controlled oscillator means 14 drives the applicator section 12 at substantially its resonant frequency.

The amplifier circuit 20 includes a drive amplifier 28 connected to receive the oscillator output signal on line 16 from the voltage controlled oscillator means 14. The drive amplifier 28 provides amplification of the oscillator output signal in response to a control voltage supplied to a gain control input 30. The amplifier means 20 further includes a power amplifier 32 connected to receive the amplified oscillator output signal on line 34 from the drive amplifier 28, and to provide the radio frequency drive signal in response thereto.

Also included in the amplifier circuit 20 are a detector 36 and a comparator amplifier circuit 38 which provide a control voltage to the gain control input 30 of amplifier 28 in response to the amplitude of the radio frequency electrical signal. The detector 36 provides a D.C. feedback level proportional to the radio frequency level on line 10. This D.C. feedback level is compared with a D.C. reference level $V_A$, provided on line 40, by means of comparator 38. By selecting the reference D.C. level $V_A$, the amplitude of the radio frequency electrical signal on line 10 may be set at any desired value and may be maintained substantially constant regardless of fluctuations in loading of the dryer applicator section.

The circuit 24, acting as a means for supplying the radio frequency drive signal to the applicator section of the dryer as the radio frequency electrical signal, includes an impedance match circuit 42, a directional coupler 44, a comparator circuit 46, and a servomotor control 48, which together act as a means for matching the output impedance of the amplifier 32 with the input impedance of the applicator section 12. As is known, impedance matching between the output of a driving circuit and a driven circuit enhances the power transfer efficiency therebetween. If the electrical signal to the applicator section 12 is at the resonant frequency of the dryer and the impedances are properly matched, no power will be reflected on line 22. The reflected power from circuit 42 is detected by directional coupler 44 which supplies a D.C. signal to line 50 which is proportional to the radio frequency power reflected back toward amplifier 32. Comparator 46 controls the servo control 48 and change the impedance transformation ratio by means of impedance match circuit 42. The transformation ratio is reduced by this servo control until the power reflected on line 22 is reduced to a minimum. Adjusting $V_B$ permits an adjustment of the operating point of amplifier 32.

Figure 2:
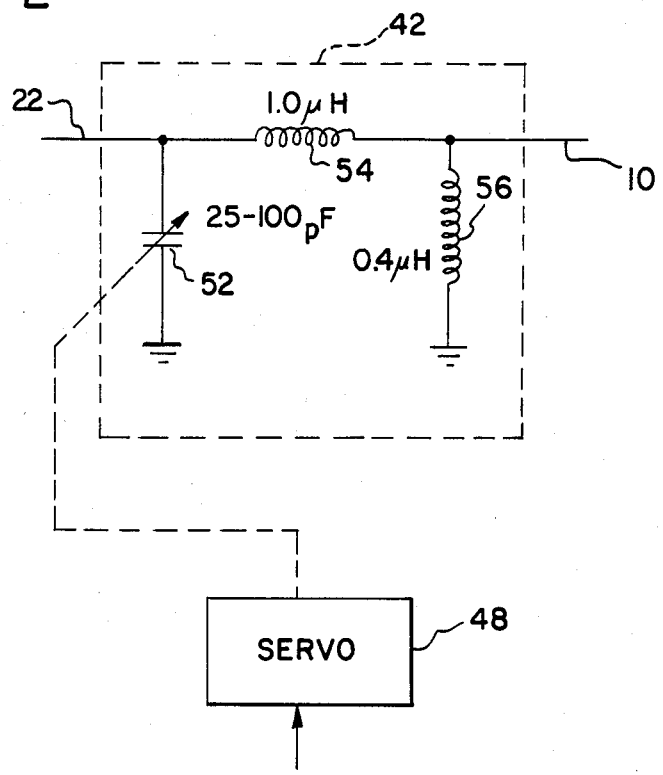
FIG. 2 is a schematic representation of an impedance matching circuit of the type that may be used in FIG. 1.

The impedance match circuit 42 may comprise an adjustable pi network. As illustrated in FIG. 2, the impedance match circuit 42 includes a variable capacitor 52 which is connected in a pi network with inductors 54 and 56. Capacitor 52 is mechanically linked to servo 48 to permit appropriate adjustment as the impedance of applicator section 12 changes. It will be appreciated that other impedance matching techniques may be substituted for that of FIG. 2.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A driving circuit for supplying a radio frequency electrical signal to the applicator section of a radio frequency dryer of the type which applies a fluctuating electromagnetic field to a printed sheet or web to induce evaporation of ink therefrom, comprising:

voltage controlled oscillator means for providing an oscillator output signal which is substantially uniform in amplitude and which is related in frequency to the control voltage supplied to a frequency control input of said voltage controlled oscillator means, amplifier means for receiving said oscillator output signal and for providing a radio frequency drive signal, means for supplying said radio frequency drive signal to said applicator section of said dryer as said radio frequency electrical signal to produce said fluctuating electromagnetic field, and phase detector means, including means responsive to said radio frequency electrical signal supplied to said applicator section and to said oscillator output signal, for providing a frequency control signal to the frequency control input of said voltage controlled oscillator means, said frequency control signal being directly related to the phase difference between said radio frequency electrical signal supplied to said applicator section and said oscillator output signal, whereby the voltage controlled oscillator means drives said applicator section at substantially the resonant frequency of said section.

2. The driving circuit of claim 1 in which said amplifier means comprises a drive amplifier connected to receive said oscillator output signal from said voltage controlled oscillator means, and providing amplification of said oscillator output signal in response to a control voltage supplied to a gain control input of said drive amplifier, a power amplifier connected to receive the amplified oscillator output signal from said drive amplifier and to provide said radio frequency drive signal in response thereto, and means for providing a control voltage to said gain control input in response to the amplitude of said radio frequency electrical signal, whereby control of the amplitude of said radio frequency electrical signal is effectively provided.

3. The driving circuit of claim 2 in which said means for providing a control voltage to said gain control input comprises:

a detctor, responsive to said radio frequency electrical signal, for providing a D.C. feedback level, means for supplying a D.C. reference level, and comparator means, responsive to said D.C. feedback level and said D.C. reference level, for supplying said control voltage to said gain control input of said drive amplifier.

4. The driving circuit of claim 1 in which said means for supplying said radio frequency drive signal to said applicator section of said dryer as said radio frequency electrical signal comprises means for matching the output impedance of said amplifier means with the input impedance of said applicator section, whereby said radio frequency electrical signal is efficiently supplied to said applicator section.

5. The driving circuit of claim 4 in which said means for matching the output impedance of said amplifier means with the input impedance of said applicator section comprises an impedance transformation circuit connecting the output of said amplifier means to said applicator section, said transformation circuit having a control input, a directional coupler, connected to the output of said amplifier means, providing a D.C. impedance control signal in respnse to the amplitude of said radio frequency drive signal, a comparator circuit, connected to receive said D.C. impedance control signal and a reference signal, for supplying to said control input of said impedance transformation circuit an output signal in response thereto.

6. The driving circuit of claim 5 in which said impedance transformation circuit includes a servomotor control connected to receive the output from said comparator circuit.

7. A method of driving the applicator section of a radio frequency dryer with a radio frequency electrical signal, comprising the steps of:

generating an A.C. oscillator output signal, amplifying said oscillator output signal to produce a radio frequency drive signal, supplying said radio frequency drive signal to the applicator section of the dryer as said radio frequency electrical signal, and detecting the phase of both said radio frequency electrical signal and said A.C. oscillator output signal and adjusting the frequency of said A.C. oscillator output signal in response to phase differences between said radio frequency electrical signal and said A.C. oscillator output signal, whereby said applicator section is driven at substantially its resonant frequency.

8. The method of claim 7, further comprising the steps of:

monitoring the amplitude of said radio frequency electrical signal, and adjusting the amount of amplification of said oscillator output signal to produce a radio frequency electrical signal of desired amplitude.

9. The method of claim 8, further comprising the steps of:

monitoring the power reflected from said applicator section, and adjusting the effective input impedance of said applicator section to permit efficient power transfer thereto.

* * * * *